United States Patent [19]

Sian

[11] 4,394,638

[45] Jul. 19, 1983

[54] MINIATURE PLUG-IN FUSE ASSEMBLY AND METHOD OF MAKING A FUSE ELEMENT THEREFOR

[75] Inventor: Sucha S. Sian, Southfield, Mich.

[73] Assignee: Essex Group, Inc., Fort Wayne, Ind.

[21] Appl. No.: 400,569

[22] Filed: Jul. 21, 1982

[51] Int. Cl.[3] ..... H01H 85/22

[52] U.S. Cl. ..... 337/264; 337/295

[58] Field of Search ..... 337/198, 201, 262, 264, 337/290, 295

[56] References Cited

U.S. PATENT DOCUMENTS

| | | | |
|---|---|---|---|
| 1,991,914 | 2/1935 | von Scheven | 339/220 |
| 2,332,483 | 10/1943 | Doty | 339/217 |
| 2,352,618 | 7/1944 | Daenz | 339/193 |
| 2,537,827 | 1/1951 | Heath | 337/261 |
| 2,861,324 | 11/1958 | Klumpp, Jr. | 29/630 |
| 3,436,711 | 4/1969 | Borzoni | 337/198 |
| 3,878,497 | 4/1975 | Spangler | 337/295 |
| 3,909,767 | 9/1975 | Williamson et al. | 337/264 |
| 4,040,175 | 8/1977 | Williamson et al. | 29/623 |
| 4,056,884 | 11/1977 | Williamson et al. | 29/623 |
| 4,131,869 | 12/1978 | Schmidt, Jr. et al. | 337/264 |
| 4,349,804 | 9/1982 | Gaia | 337/295 X |

*Primary Examiner*—George Harris

*Attorney, Agent, or Firm*—Robert D. Sommer

[57] ABSTRACT

A plug-in fuse assembly comprises a one-piece fuse element secured to a housing and having tubular terminal prong portions adapted for insertion into receptacle terminals. The terminal prong portions have retaining means cooperating with locking means formed in the housing for fixedly securing the terminal prong portions to the housing. A fuse link portion of the fuse element extends transversely between the terminal prong portions and is enclosed by the housing. The fuse element is made by punching from a flat sheet of fuse metal a flat blank comprising two laterally spaced and longitudinally extending prong members interconnected at their inner lateral edges by a link member having a non-rectilinear configuration, and then elongating the link member by flexing it from its non-rectilinear configuration to define the fuse link portion while shaping the prong members into tubular form to define the terminal prong portions.

8 Claims, 7 Drawing Figures

FIG. 1
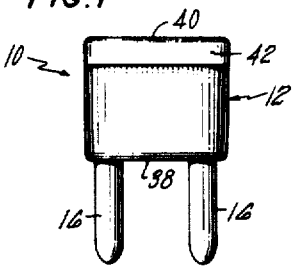
FIG. 4
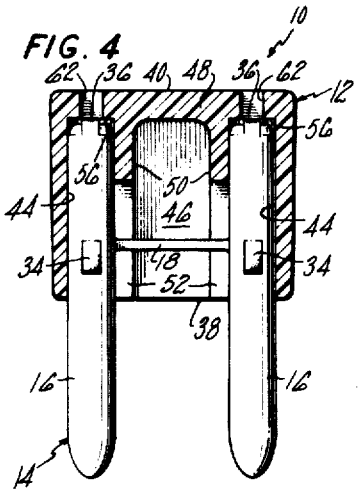
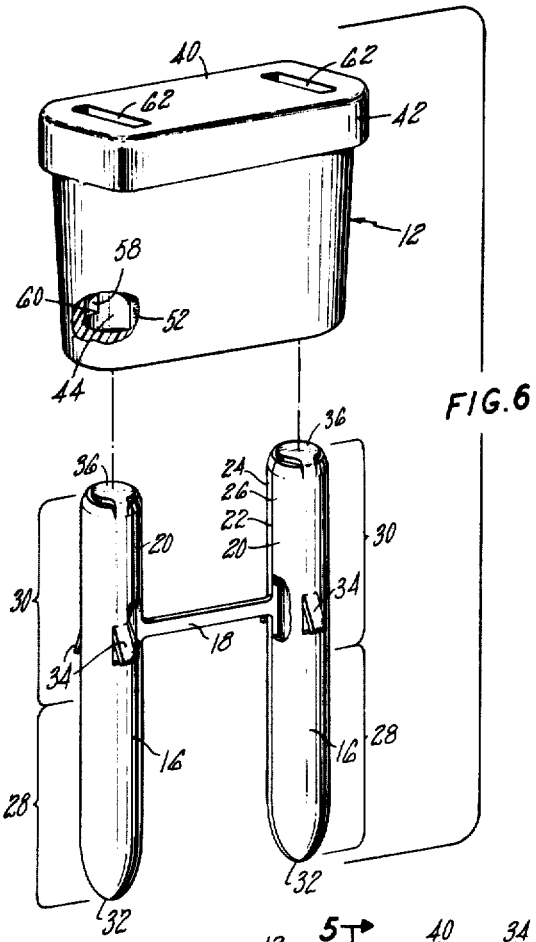
FIG. 6
FIG. 5
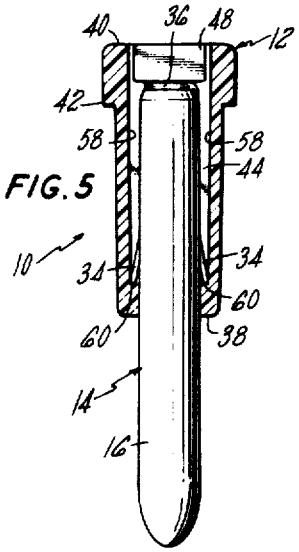
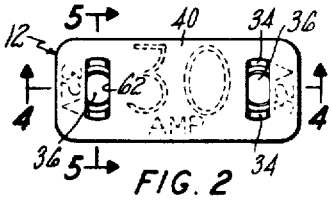
FIG. 2
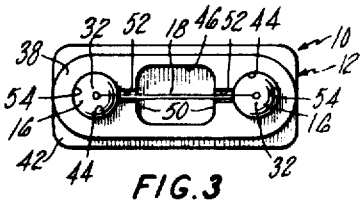
FIG. 3

MINIATURE PLUG-IN FUSE ASSEMBLY AND METHOD OF MAKING A FUSE ELEMENT THEREFOR

BACKGROUND OF THE INVENTION

This invention relates generally to plug-in fuse assemblies and more specifically to miniature plug-in fuse assemblies of the type comprising a one-piece fuse element formed of fuse sheet metal and secured to a housing of insulation material.

Miniature plug-in fuse assemblies consisting of a one-piece fuse element formed from fuse metal and secured to a plastic housing have been heretofore developed for use in automotive vehicle circuits. Fuse assemblies of this type have been disclosed in a number of patents including the following U.S. patents:

U.S. Pat. No. 3,909,767—Williamson et al.—Sept. 30, 1975

U.S. Pat. No. 4,040,175—Williamson et al. —Aug. 9, 1977

U.S. Pat. No. 4,056,884—Williamson et al. —Nov. 8, 1977

U.S. Pat. No. 4,131,869—Schmidt, Jr. et al.—Dec. 26, 1978

In the plug-in fuse assemblies of the type disclosed in the aforesaid patents, the fuse element is stamped from relatively thick metal stock to provide terminal prong portions of adequate strength and rigidity. The blade type terminal prong portions are of a substantial width requiring a larger housing than necessary if the terminal prong portions were in the form of cylindrical pins providing equivalent areas of contact surfaces. Other types of plug-in fuse assemblies previously developed have employed terminal prong portions in the form of cylindrical pins secured to a housing but required the mechanical attachment of a separate link or fuse wire to the terminal prong portions. Examples of such fuse assemblies are found in the Heath U.S. Pat. No. 2,537,827 issued Jan. 9, 1951 and in the Borzoni U.S. Pat. No. 3,436,711 issued Apr. 1, 1969.

The Spangler U.S. Pat. No. 3,878,497 issued Apr. 15, 1975 shows a fuse assembly which includes a one-piece fuse element formed of sheet metal. The fuse element comprises terminal receptacle portions of tubular form at opposite ends of a central fuse link portion. This type of fuse element construction is not particularly suitable for arrangement in loop shape with the fuse link portion extending transversely between a pair of laterally spaced terminal portions for use in a miniature plug-in fuse assembly.

In the electrical connector art, it has been found advantageous to stamp and roll tubular terminals from sheet metal. Examples of such tubular terminals are shown in the aforesaid U.S. Pat. No. 2,537,827, in the von Scheven U.S. Pat. No. 1,991,914 issued Feb. 19, 1935, and in the Klumpp, Jr. U.S. Pat. No. 2,861,324 issued Nov. 25, 1958. Electrical connectors are also known which employ tubular terminals stamped from sheet metal and so constructed that they may be assembled and anchored with a plastic housing by mere axial insertion into bores in the housing. Examples of such connectors are shown in the Doty U.S. Pat. No. 2,332,483 issued Oct. 19, 1943 and in the Daenz U.S. Pat. No. 2,353,618 issued July 4, 1944. Connectors of this type are well-suited to mass production techniques at low labor and material costs but the full advantages of such techniques have not been utilized in the manufacture of plug-in fuse assemblies because of the problems presented by the construction and arrangement of the parts comprising heretofore known miniature plug-in fuse assemblies.

SUMMARY OF THE INVENTION

The present invention provides an improved miniature plug-in fuse assembly of the type comprising a one-piece fuse element formed of fuse sheet metal and secured to a housing formed of insulation material. The fuse element has two laterally spaced generally parallel conductive terminal prong portions and a fuse link portion of substantially smaller cross sectional area than the terminal prong portions extending transversely between the terminal prong portions. Each terminal prong portion comprises a tubular body having an annular wall with contiguous edges thereof defining a longitudinally extending seam which is in generally coplanar relation with and faces the longitudinally extending seam of the other terminal prong portion. Each of the tubular bodies has a forward contacting section adapted for insertion into a receptacle contact and an integral retention section rearward of the contacting section. The fuse link portion extends laterally from the retention section proximate the respective seams thereof.

The housing has three substantially parallel bores extending from the front surface thereof toward the rear surface of the housing and further has a separating wall between the medial one of the bores and each of the outer bores with a slot therein. The retention sections of the terminal prong portions are received in respective ones of the outer bores and respective proximal end sections of the fuse link portions are received in the slots. The medial bore receives the central section of the fuse link portion with that section being substantially spaced from any part of the housing. Retaining means on the retention sections of the terminal prong portions and locking means in the outer bores of the housing cooperate to fixedly secure the terminal prong portions to the housing upon axial insertion of the retention sections into the outer bores.

According to a preferred embodiment of the invention, each of the outer bores extend from the front surface of the housing to a transverse rear wall providing a rear locking shoulder. Each outer bore is further defined by a generally cylindrical side surface containing two channel-shaped recesses extending lengthwise in opposed sides thereof and substantially equidistantly spaced from the slot in the adjoining separating wall. Each channel-shaped recess terminates at a rearwardly facing forward locking shoulder within an outer bore. Each of the retention sections of the terminal prong portions is of a generally cylindrical shape and includes rear end retaining means engageable with a rear locking shoulder in an associated one of the outer bores to restrict rearward movement of the terminal prong portion in the outer bore. Each of the retention sections further includes two integral resilient retaining tabs struck from opposite sides of the wall thereof and substantially equidistantly spaced from the seam thereof. Each retaining tab extends forwardly and outwardly from the wall and has a distal end engageable with a forward locking shoulder in a respective channel-shaped recess to restrict forward movement of the respective terminal prong portion in its associated outer bore. The channel-shaped recesses preferably extend from the outer bores to the rear surface of the housing and define the ends of two relatively narrow access openings formed in the rear surface which communicate with the respective ones of the outer bores. In addition, each forward contacting section of the terminal prong portions is preferably of a generally cylindrical shape with an outer diameter generally equal to that of its respective retention section and terminates at its forward end in a substantially closed front region.

The present invention is further directed to a method of economically mass producing fuse elements from an elongated sheet of fuse metal that is potentially divisible into successive incremental lengths from each of which a fuse element blank and a connecting strip is available. The sheet is advanced longitudinally in successive steps along a fixed path of travel lying in a predetermined plane, and each incremental length thereof is subjected to at least one punching operation to form a flat connecting strip and a flat fuse element blank. Each of the fuse element blanks includes two laterally spaced and longitudinally extending prong members interconnected at their inner lateral edges by a link member of substantially smaller cross sectional area than the prong members and having a non-rectilinear configuration. Each prong member is connected at one end of the connecting strip and at its other end to a successive connecting strip by a respective narrow tongue member. The tongue members at the opposite ends of each prong member are disposed along a respective longitudinal line substantially closer to the inner lateral edge of each prong member than to the outer lateral edge thereof. The two longitudinal lines extend generally parallel to the fixed path of travel of the sheet and are spaced from each other a distance substantially equal to the desired distance of lateral spacing between the longitudinal axes of the terminal prong portions to be formed from the prong members. Thereafter while the tongue members are maintained in the plane of the sheet, each fuse element blank is subjected to at least one shaping operation to displace the respective inner and outer lateral edges of the prong members out of the plane of the sheet and shape each prong member into tubular form to define terminal prong portions. At the same time, the link member is also displaced out of the plane of the sheet and flexed from its non-rectilinear configuration to thereby elongate the link member to define a fuse link portion. Each thus formed and shaped fuse element is thereafter severed from the connecting strips. The trailing end of each prong member is preferably formed with a pair of arcuately shaped extensions which are brought close together to substantially close that end.

For a better understanding of the invention, reference may be had to the following detailed description taken in connection with the accompanying drawing, in which:

BRIEF DESCRIPTION OF THE DRAWING

FIG. 1 is a side elevational view of a plug-in fuse assembly according to the present invention;

FIG. 2 is an enlarged top plan view of the fuse assembly of FIG. 1;

FIG. 3 is an enlarged bottom view of the fuse assembly of FIG. 1;

FIG. 4 is a sectional view taken substantially along the line 4—4 of FIG. 3;

FIG. 5 is a sectional view taken substantially along the line 5—5 of FIG. 3;

FIG. 6 is an enlarged, exploded perspective view, partially broken away, of the fuse assembly of FIG. 1.

DETAILED DESCRIPTION OF THE INVENTION

Figure 7:
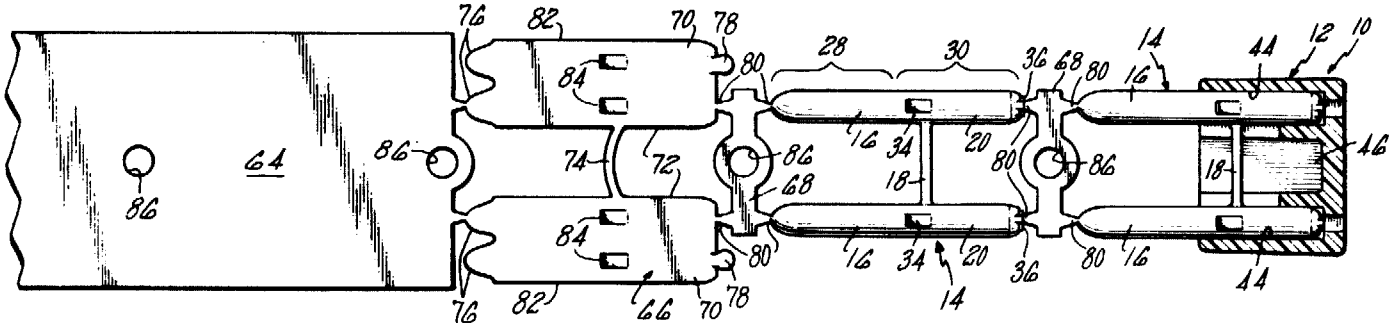
FIG. 7 is an enlarged plan view, partially in section, illustrating a method of making a fuse element from a sheet of fuse metal and inserting the fuse element into a housing.

Referring now to the drawing, a plug-in fuse assembly 10 in accordance with the present invention comprises a housing 12 molded of electrical insulation material such as a nylon or acrylic resin and a one-piece composite fuse element 14 which is constructed from a sheet of fuse metal stamped and shaped into the configuration shown. The fuse element 14 comprises two laterally spaced, generally parallel conductive terminal prong portions 16 and a fuse link portion 18 extending transversely between the terminal prong portions 16.

Each prong portion 16 comprises a generally tubular body 20 having a longitudinally extending, substantially closed seam 22 therein at the contiguous edges 24 and 26 of an annular wall. Each prong portion 16 may be considered as having a forward contacting section 28 and a retention section 30 rearward of the contacting section 28. Each forward contacting section 28 is of a generally cylindrical shape and may terminate at its forward end in a substantially closed front region 32 for insertion of the contacting section 28 into a conventional conductive receptacle contact or terminal (not shown).

Each retention section 30 is also of a generally cylindrical shape with an outer diameter generally equal to that of its associated contacting section 28. The rear end of each retention section 30 is substantially closed by a generally circular cap 36 which is integrally connected at one edge thereof to the retention section. A pair of aligned resilient retaining tabs 34 are struck from the wall of each retention section 30 on opposite sides thereof and are substantially equidistantly spaced from the seam 22 of the retention section 30. The retaining tabs 34 extend forwardly and outwardly from the walls of the retention sections 30 and together with the rear end caps 36 of the retention sections 30 are adapted to retain the retention sections 30 in bores in the housing 12 as will be described below. The terminal prong portions 16 are formed with the seams 22 thereof in a generally coplanar relation and facing each other. The fuse link portion 18 is integrally joined to the retention sections 30 at the edges 24 and extends laterally therefrom proximate the respective seams 22.

The housing 12 is of a somewhat rectangular configuration with parallel spaced forward and rear surfaces 38 and 40, respectively, and preferably has an outstanding flange or ledge 42 at its rear end by which the fuse assembly 10 may be manually grasped. As shown in FIG. 2, suitable indicia may be formed on the rear surface 40 of the housing 12 to indicate the voltage and current ratings of the fuse assembly 10. The housing 12 is provided with substantially parallel bores 44, 46 and 44 extending from the forward surface 38 to a transverse rear wall 48 and includes a separating wall 50 between the medial bore 46 and each outer bore 44 having a slot 52 therein. The medial bore 46 is preferably rectangular in section. The outer bores 44 which are preferably circular in section are defined by generally cylindrical side surfaces 54 and terminate at rear locking shoulders 56 provided by the rear wall 48. Each outer bore 44 further has two longitudinally extending channel-shaped recesses 58 in opposed sides of the side surface 54 thereof which are substantially equidistantly spaced from the slot 52 in the adjacent separating wall 50. At their forward ends, the channel-shaped recesses terminate in respective rearwardly facing forward locking shoulders 60 spaced rearwardly behind the forward surface 38 of the housing 12. The associated pair of channel-shaped recesses 58 in each outer bore 44 merge at their rear ends with a narrow access opening 62 which extends through the rear wall 48 of the housing 12 in communication with the respective outer bore 44.

To assemble the fuse assembly 10, the retention sections 30 of the fuse element 14 are axially inserted into the respective outer bores 44 of the housing 12 from the forward end thereof with the proximal end sections of the fuse link portion 18 being received in respective ones of the slots 52 and the central section of the fuse link portion 18 being received in the medial bore 46. The retaining tabs 34 are flexed inwardly as the retention sections 30 first enter the outer bores 44 and then snap outwardly to their original undeflected condition into the respective channel-shaped recesses 58 when full insertion of the fuse element 14 is effected. Immediately after the retaining tabs 34 enter the recesses 58, rear end caps 36 of the retention sections 30 engage the respective rear locking shoulders 56 at the ends of the outer bores 44 thereby stopping further rearward movement of the fuse element 14. Since return movement in the forward direction is prevented by engagement of the distal ends of the retaining tabs 34 with the respective forward locking shoulder 60 in the recesses 58, both forward and rearward movement of the terminal prong portions 16 is restricted. Moreover, the reception of the retaining tabs 34 in the recesses 58 maintains the desired orientation of the retention sections 30 in the outer bores 44 and fixedly prevents any rotational movement thereof. Thus, the terminal prong portions 16 are fixedly secured to the housing 12.

In the assembled fuse assembly 10, the central section of the fuse link portion 18 within the medial bore 46 is substantially spaced from any part of the housing 12 and is thus substantially thermally isolated from the housing 12. Although the fuse link portion 18 is of the same thickness as that of the tubular body of each terminal prong portion 16, it has a substantially smaller current carrying cross sectional area than the current carrying cross sectional area of the terminal prong portions 16 so that its central section will melt when a current in excess of a predetermined value flows through it. The relatively limited heat generated by current flow through the terminal prong portions 16 is readily dissipated because of their relatively larger surface area and their engagement with recepticle contacts (not shown). It will be understood that different fuse ratings can be obtained by forming fuse element 14 from fuse sheet metal stock of different thicknesses or compositions and by changing the width of the fuse link portion 18.

Fuse assemblies 10 in accordance with this invention can be manufactured in small sizes with their terminal prong portions 16 located on closely spaced centers. A fuse assembly 10 constructed as shown and described herein with a rating of 30 amperes has a length of about 13.5 mm., a width of about 5.6 mm. and an overall height including the contacting sections 28 of the terminal prong portions 16 of about 21 mm. The terminal prong portions 16 are about 2.5 mm. in diameter and are mounted in the housing 12 on spaced center about 8.9 mm. apart.

There is illustrated in FIG. 7 a method for readily manufacturing the fuse element 14 from an elongated flat sheet 64 of fuse metal which is potentially divisible into successive incremental lengths. As the sheet 64 is intermittently advanced longitudinally in successive steps along a fixed path of travel lying in a predetermined plane, each incremental length is subjected to punching and shaping operations performed by a progressive die (not shown). In the punching operation or operations, various opening are punched in each incremental length of the sheet 64 to provide a flat blank 66 from which the fuse element 14 is shaped and a flat connecting strip 68 for joining each blank 66 to a successive blank.

Each fuse element blank 66 includes two laterally spaced and longitudinally extending prong members 70 interconnected at their inner lateral edges 72 by a link member 74 of substantially smaller cross sectional area than that of the prong members 70. For a purpose to be explained later, the link member 74 has an arcuately shaped or other non-rectilinear configuration. The trailing end of each prong member 70 is formed with a pair of arcuately shaped extension 76, and the leading end of each prong member is formed with an outwardly projecting cap member 78. The forward and trailing ends of each prong member 70 are connected to respective connecting strips 68 by narrow tongue members 80 of a width which is substantially less than the width of each prong member 70. The tongue members 80 at the opposite ends of each prong member 70 are disposed along a respective longitudinal line substantially closer to the inner lateral edge 72 of the prong member 70 than to the outer lateral edge 82 thereof. These longitudinal lines extend generally parallel to the fixed path of travel along which the sheet 64 is advanced and are spaced from each other a distance substantially equal to the desired distance of lateral spacing between the respective longitudinal axes of the terminal prong portions 16 which are formed from the prong members 70. A pair of tab members 84 are stamped from each prong member 70 and bent outwardly at an acute angle relative to the plane of the blank 66 to define the retaining tabs 34. It will be noted that the tab member 84 adjacent the inner lateral edge 72 of each prong member 70 is disposed generally along the respective longitudinal line along which the tongue members 80 are disposed at a distance from the inner lateral edge 72 generally equal to the distance between the other tab member 80 and the outer lateral edge 82 of the prong member 70. A pilot pin hole 86 may be punched in each connecting strip 68 to function as indexing means for precisely locating the sheet 64 during the punching and shaping operations.

In the shaping operation or operations, the connecting strips 68 and the tongue members 80 are maintained in the plane of sheet 64 while forming dies (not shown) displace the respective inner and out lateral edges 72, 82 of each prong member 70 out of the plane of sheet 64 in the same one direction and shape each prong member into tubular form to define the terminal prong portions 14. At the same time, each cap member 78 is bent against the rear end of a respective terminal portion 16 and the arcuately shaped extensions 76 are brought close together to form the substantially closed front region 32 of each terminal prong 16. While the prong members 70 are being shaped into tubular form, the inner lateral edges 72 are spread apart from each other as they are displaced out of the plane of sheet 64 and brought into adjoining relation with the respective outer lateral edges 82. The link member 74 which remains joined to the prong members 70 at the inner lateral edges 72 is also displaced from the plane of sheet 64 and is also elongated to accommodate the increased separation between the inner lateral edges 72. This elongation is effected by flexing of the link member 74 from its non-rectilinear configuration to a more linear configuration which defines the fuse link portion 18.

The completed fuse elements 14 may be sequentially inserted into housings 12 with the terminal prong portions 16 still joined to a connecting section 68 as illustrated in FIG. 7. When full insertion of a fuse element 14 is effected as described above, the connecting strip 68 with its tongue members 80 is severed from the inserted fuse element and the successive fuse element. Accordingly, it will be evident that the foregoing method of making fuse elements is well suited to accommodate mechanized assembly of the fuse elements with their housings.

Instead of inserting the fuse element 14 into a previously molded housing 12 as described above, the fuse element 14 may be positioned in a mold cavity (not shown) and a fluid plastic material such as a nylon or acrylic resin may be injected into the mold cavity to form the housing 12 about the fuse link portion 18 and the retention sections 30 of the fuse element. As the fuse element is firmly embedded in the housing by virtue of the molding operation, the retention sections 30 need not be provided with the retaining tabs 34. It is further contemplated that the central portion of the housing in contact with the central section of the fuse link portion 18 may be of a reduced dimension as compared to that of the housing portions in contact with the retention sections 30.

While there have been described above the principles of this invention in connection with a specific plug-in fuse assembly construction and a specific method of making a fuse element therefore, it is to be understood that this description is made only by way of example and not as a limitation to the scope of the invention.

What is claimed is:

1. A plug-in fuse assembly of the type comprising a housing formed of insulation material and a one-piece composite fuse element formed of fuse sheet metal and secured to said housing, said fuse element having two laterally spaced generally parallel conductive terminal prong portions and a fuse link portion of substantially smaller cross sectional area than said terminal prong portions extending transversely between said terminal prong portions, said fuse assembly being characterised in that:

each of said terminal prong portions comprises a tubular body having an annular wall with contiguous edges thereof defining a longitudinally extending seam, each of said tubular bodies having a forward contacting section adapted for insertion into a conductive receptacle contact and an integral retention section rearward of said contacting section, said terminal prong portions being formed with said seams in a generally coplanar relation and facing each other, said fuse link portion extending laterally from said retention sections proximate respective seams thereof; said retention sections and said fuse link portion being secured within said housing.

2. A fuse assembly according to claim 1 wherein said housing has three substantially parallel bores extending from the front surface thereof toward the rear surface of said housing, said housing including a separating wall between the medial one of said bores and each of the outer two of said bores having a slot therein, each of said outer bores receiving the retention section of an associated one of said terminal prong portions, each of said slots receiving a respective one of the proximal end sections of said fuse link portion, said medial bore receiving the central section of said fuse link portion with the latter section being substantially spaced from any part of said housing; and said terminal prong portions have retaining means on their retention sections and said housing has locking means in said outer bores cooperating with said retaining means to fixedly secure said terminal prong portions to said housing upon axial insertion of said retention sections into said outer bores.

3. A fuel assembly according to claim 2 wherein each of said outer bores extend from the front surface of said housing to a transverse rear wall providing a rear locking shoulder, each of said outer bores further being defined by a generally cylindrical side surface containing at least one channel-shaped recess extending lengthwise along said outer bore and terminating at a rearwardly facing forward locking shoulder within the outer bore, each of said retention sections being of a generally cylindrical shape and including rear end retaining means engageable with a rear locking shoulder in an associated one of said outer bores to restrict rearward movement of the respective terminal prong portion in said outer bore, each of said retention sections further including at least one integral resilient retaining tab struck from the wall thereof and extending forwardly and outwardly therefrom, the distal end of each said retaining tab being engageable with a forward locking shoulder in an associated one of said outer bores to restrict forward movement of the respective terminal prong portion of said outer bore.

4. A fuse assembly according to claim 3 wherein each of said retention sections has two of said retaining tabs struck from the wall thereof on opposite sides thereof and substantially equidistantly spaced from the seam thereof, each of said outer bores having two of said channel-shaped recesses in opposed sides of the side surface thereof and substantially equidistantly spaced from the slot in the respective separating wall between said outer bore and said medial bore, said channel-shaped recesses being shaped to receive the respective distal ends of said retaining tabs for fixedly preventing rotational movement of said terminal prong portions in said bores relative to said housing.

5. A fuse assembly according to claim 4 wherein said channel-shaped recesses extend from said outer bores to a rear surface of said housing and define the ends of two relatively narrow access opening formed in said rear surface which communicate with respective ones of said outer bores.

6. A fuse assembly according to claim 4 wherein each of said forward contacting section is of a generally cylindrical shape with an outer diameter generally equal to that of its respective retention section and terminates at its forward end in a substantially closed front region.

7. A method of making one-piece composite fuse elements each having two generally parallel tubular terminal prong portions with respective longitudinal axes laterally spaced a predetermined distance apart and a fuse link portion of substantially smaller cross sectional area than said terminal prong portions extending transversely between said terminal prong portions characterized by the steps of:

providing an elongated flat sheet of fuse metal that is potentially divisible into successive incremental lengths from each of which a fuse element blank and a connecting strip is available;

advancing said sheet longitudinally in successive steps along a fixed path of travel lying in a predetermined plane;

subjecting each incremental length of said sheet to at least one punching operation to thereby form a flat connecting strip and a flat fuse element blank, each of said fuse element blanks including two laterally spaced and longitudinally extending prong members interconnected at their inner lateral edges by a link member of substantially smaller cross sectional area than said prong members and having a non-rectilinear configuration, each of said prong members being connected at one end of said connecting strip and at its other end to a successive connecting strip by a respective narrow tongue member of a width which is substantially less than the width of each said prong member, the tongue members at the opposite ends of each prong member being disposed along a respective longitudinal line substantially closer to the inner lateral edge of each said prong member than to the outer lateral edge thereof; said longitudinal lines extending generally parallel to said fixed path of travel and being spaced from each other a distance substantially equal to said predetermined distance of lateral spacing between the longitudinal axes of said terminal prong portions;

thereafter while maintaining said tongue members in the plane of said sheet along respective ones of said longitudinal lines subjecting each fuse element blank to at least one shaping operation to thereby displace the respective inner and outer lateral edges of the prong members thereof out of the plane of said sheet in the same one direction and shape each said prong member into tubular form to define said terminal prong portions, the link member of each said fuse element blank being displaced out of the plane of said sheet in said one direction and being flexed from said non-rectilinear configuration to thereby elongate said link member to define said fuse link portion while said prong members are being displaced and shaped;

and thereafter severing each formed and shaped fuse element from the connecting strips.

8. The method of making fuse elements according to claim 7 wherein said other end of each of said prong members of the fuse element blanks is formed with a pair of arcuately shaped extensions and said arcuately shaped extensions are brought close together during said at least one shaping operation to substantially close that said other end.

* * * * *